US008426710B2

(12) United States Patent
Georgatos

(10) Patent No.: US 8,426,710 B2
(45) Date of Patent: Apr. 23, 2013

(54) PLECTRUM AND METHOD OF FABRICATING

(76) Inventor: Dennis Georgatos, Selden, NY (US)

( * ) Notice: Subject to any disclaimer, the term of this patent is extended or adjusted under 35 U.S.C. 154(b) by 52 days.

(21) Appl. No.: 13/082,835

(22) Filed: Apr. 8, 2011

(65) Prior Publication Data

US 2012/0255420 A1 Oct. 11, 2012

(51) Int. Cl.
*G10D 3/16* (2006.01)

(52) U.S. Cl.
USPC ..... 84/320

(58) Field of Classification Search ..... 84/320–322, 84/315–317
See application file for complete search history.

(56) References Cited

U.S. PATENT DOCUMENTS 5,505,030 A * 4/1996 Michalcewiz et al. ..... 52/249
2009/0293700 A1 * 12/2009 Dybas ..... 84/322

* cited by examiner

*Primary Examiner* — Kimberly Lockett
(74) *Attorney, Agent, or Firm* — James J. Lillie; Lillie Law, LLC

(57) ABSTRACT

A plectrum having a body made from an organic material having a desired shape, weight, and thickness, the body having a plurality of surfaces wherein opposing sides, a first and a second side, form an edge about the perimeter of said sides, wherein the perimeter forms a silhouette that is substantially scalene.

15 Claims, 1 Drawing Sheet

PLECTRUM AND METHOD OF FABRICATING

BACKGROUND OF THE INVENTION

This invention relates to a plectrum, in particular, an improved plectrum that provides, inter alia, a purer tone.

Historically, string instruments such as, inter alia, the guitar, harpsichord, and bouzouki, have been played either by the unassisted hand (fingers) or sometimes with the aid of a plectrum. Moreover, the material used to fabricate these plectrum have evolved towards the use of synthetics for, inter alia, greater quality control in production, enhanced durability in performance, and more contemporaneously for environmental reasons, wherein a durable plastic, such as acetal copolymer, a thermoplastic resin, sold as DuPont™ DELRIN® is quite popular.

Instrument plectrums can change your instrument sound and alter your playing style dramatically; they come in a variety of shapes, sizes, and colors and are made from numerous materials in varying thicknesses. Although individual playing style affects sound quality, the various attributes of the plectrum also contribute to overall instrument tone.

Plectrum material is an important consideration when shopping for plectrums, as set forth above. Harder materials such as metal and stone provide quicker string attack and volume while adding a bright tone, whereas softer materials like plastics produce less attack and volume with a more natural tone. Stone and metal plectrums do not wear out but are costly, but nylon and plastics wear at different rates, depending on playing style and material quality, but are low in price, moreover popular plastic plectrum materials include celluloid, nylon and other durable plastics.

The shape of an instrument plectrum has more to do with comfort than sound, wherein most plectrums are triangular or teardrop-shaped but differ in size. Depending on material and thickness, larger plectrums are more flexible and easier to hold, while smaller plectrums are less flexible and more challenging to hold. The ability to securely hold a plectrum of any size comes with experience, and experience will also show the different sounds you can make with plectrums of differing sizes.

Additionally, plectrums vary in thicknesses. Stone or metal plectrums are always rigid, regardless of thickness, so the thickness of these plectrums is chosen more for comfort than tone or volume. Plastic and nylon plectrums of thinner sizes bend slightly and deflect after striking the strings. This is called "flutter" or plectrum noise, and wherein desirability is a function of the player's preference. Thinner plectrums also produce less volume because of plectrum deflection, whereas thicker plectrums deflect less and produce less flutter, and produce more volume and string attack.

The edge of the plectrum is an important attribute in string attack. Most triangular plectrums have a main edge that is pointed, with the remaining edges rounded off. Playing with the pointed edge produces a sharp tone with fast string attack, while using the rounded edge produces a softer tone with less string attack. Some specialty plectrums have a serrated edge for special effects, as well as round and pointed edges for standard playing.

Regardless of plectrum material, size, shape, and edge, the player's technique is a contributing factor in creating the desired tone. There are numerous ways to hold a plectrum, which vary greatly from player to player. Some players use different holding and angle techniques for different effects, and although the most common holding method is between the thumb and forefinger, there is no right or wrong way to hold a plectrum. Holding the playing edge of a thinner plectrum close to the fingertips ("choking up") will lessen plectrum deflection, produce more volume, and increase string attack. Holding a thicker plectrum with a loose and flexible finger grip will produce less volume and attack but increase deflection.

Since the combination of material, thickness, edge, shape, and playing technique produces different instrument sounds, experience and experimentation are key to choosing the right plectrum; however, there is an ongoing need to increase the purity of tone.

Horseshoe crabs are among the world's oldest and most fascinating creatures. The earliest horseshoe crab species had already inhabited Earth at least 200 million years before the dinosaurs arrived or about 400 million years ago. Today, there are four species of horseshoe crabs in the world, but only one is found on North American shores. *Limulus polyphemus* is found along the western Atlantic and Gulf coasts from southern Maine to the Yucatan Peninsula, with the Delaware Bay as the center of the population, whereas *Tachypleus gigas* and *Carcinoscorpius rotundicauda* are found in the Indo-Pacific region from the Bay of Bengal to Indonesia and Borneo. *Tachypleus tridentatus* ranges from the Philippines to the southwestern seas of Japan.

Horseshoe crabs initially molt or shed their outer skeleton (exoskeleton) an average of three or four times a year. Subadults (horseshoe crabs that are five to seven years old) appear to molt annually. The animals increase in size by 25-30% with each molt by pumping in water to expand their new shells, which will harden in approximately 24 hours. Males are sexually mature at their sixteenth molt, which is usually their eighth or ninth year. During their final molt, they develop specialized clasping claws for holding the female during reproduction. Females need at least 17 molts, or one more than the males, so they mature in their tenth year or even later and are, on the average, 30% larger than the males. A small percentage of horseshoe crabs continue to molt after reaching sexual maturity.

A mature male ranges from 7-9 inches across the helmet-like prosoma, with an overall length, from head to tail, of 13-16 inches long. Mature females typically are much larger than the males, ranging from 9-12 inches across the widest part of the shell and 16-20 inches long.

Scientists are not sure how long horseshoe crabs live, but some speculate that they can live for 20 to 30 years or more. Because very few horseshoe crabs live to maturity, the ones that do must have a life span that enables them to reproduce for a number of years.

Native American Indians who inhabited our shores many years ago were the first to recognize the importance of the horseshoe crab. They ate the meat found in the opisthosoma, which contains the muscles that move the horseshoe crab's tail and possibly some organs in the prosoma, the front, semicircular part of the horseshoe crab.

They also used the crab's shell to bail water from their canoes and its tail for a spear tip. Indians also discovered that the horseshoe crab is an excellent fertilizer (it is rich in nitrogen, which is gradually released into the soil). Indians taught the early settlers how to fertilize their crops with fish and horseshoe crabs. This knowledge became the base of a strong fertilizer industry in Delaware and New Jersey that lasted into the 1950s.

The earliest reports of harvesting horseshoe crabs date back to colonial times. Farmers in the 1800s continued the practice of using horseshoe crabs for fertilizer. Records show that in the 1870s, over four million crabs were taken each year. They were harvested from the beaches by hand or from the water with the use of pound nets. The crabs were dried and ground up before they were applied to the fields. Even with this harvesting pressure, the population of horseshoe crabs remained at about 1.5 million from the 1880s through the 1920s. But from then on, the population declined steadily with each decade until the 1960s. Because of the decline in the stock and an increase in the demand for chemical fertilizers, harvesting horseshoe crabs for fertilizer ceased in the 1960s.

Besides its use as fertilizer, some farmers also used horseshoe crabs as a cheap source of food for chickens and hogs. However, the crabs gave the meat a "fishy" taste that required weeks of purging on grain to remove.

Today, horseshoe crabs are once again in demand—this time for biomedical research and the production of LAL, and as bait for the eel and whelk fisheries. As a result of these current trends, there is a surplus of exoskeletons therefrom, especially given the frequency of molting, and a need to determine a green policy to utilize the same.

SUMMARY OF THE INVENTION

The present invention is directed to an improved plectrum having the primary advantage of increased quality of tone.

An objective of the present invention is to improve reliability of performance.

Another objective of the present invention includes extended useful life of the plectrum.

A further objective of the present invention includes improved ergonometrics and ease of use.

A still further objective of the present invention includes a green approach in selecting raw materials and fabricating a plectrum.

Other objectives, advantages, and novel features of the present invention will become more apparent from the following detailed description when taken in conjunction with the accompanying drawings.

BRIEF DESCRIPTION OF THE DRAWINGS

The following drawings, in which like reference characters indicate like parts, are provided for illustration of the invention and are not intended to limit the invention in any manner whatsoever.

DETAILED DESCRIPTION OF THE INVENTION

Figure 1:
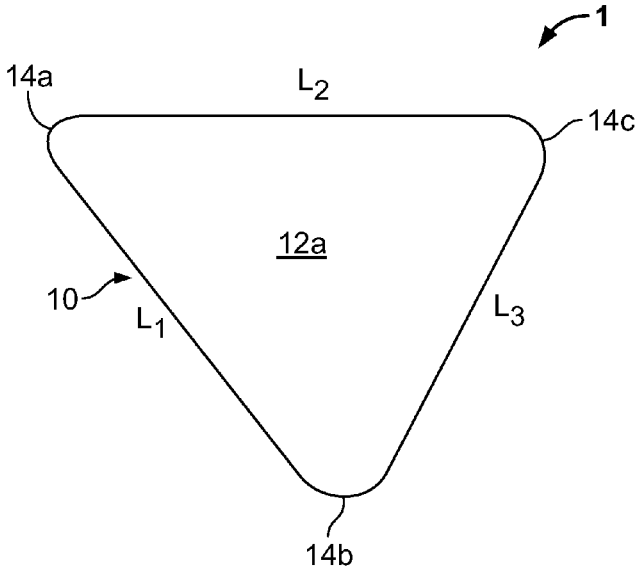
FIG. 1 illustrates a front view of the preferred embodiment.
Figure 2:
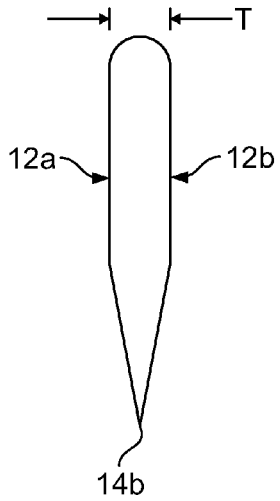
FIG. 2 illustrates a side view of the preferred embodiment.

The following descriptions of the preferred embodiments are presented to illustrate the present invention and are not to be construed to limit the claims in any manner whatsoever. In reference to the drawings, namely FIGS. 1 to 3, the preferred embodiment of the present invention is disclosed, which is directed to a plectrum 1 comprising: a body 10 made from an organic material having a desired shape, weight, and thickness T.

The body 10 is made from a material comprising an exoskeleton, namely, the exoskeleton from a horseshoe crab. Moreover, the thickness T of the plectrum ranges from about 0.40 millimeters to about 1.50 millimeters. The surface area of the plectrum ranges from about 0.25 square inches to about 4.00 square inches, although the preferred range is about 1.00 to about 2.56 square inches.

The body 10 having a plurality of surfaces wherein opposing sides, a first 12*a* and a second side 12*b*, wherein the first side and second side are not parallel 12*a*, 12*b*. The sides 12*a*, 12*b* form an edge E about the perimeter of said sides 12*a*, 12*b*, wherein said perimeter forms a silhouette, and has a plurality of corners 14*a*, 14*b*, 14*c*.

The body 10 has a surface area of less than about four (4) square inches, and the silhouette is substantially scalene in nature, that is, no two lengths L1≠L2≠L3 approach being the same dimension. Although it is preferred that the plurality of corners are asymmetrical to each other, yet the perimeter is substantially smooth, wherein the lengths L1, L2, L3 may either be concave, convex, straight, or a combination thereof.

A method of fabricating a plectrum comprising bleaching an exoskeleton, wherein the bleaching of the exoskeleton further comprises soaking in a solution comprising bleach for about three (3) hours. The method further includes forming a body 10 of a plectrum to the desired shape and size by cutting, which may be achieved via cutting by hand, by machine, or combination thereof. The method of fabricating a plectrum further includes forming of a body 10 by separating the layers of the exoskeleton to a desired first and second thickness or leaving the layers together for a larger thickness, that is, the fabricator selects a desired thickness as set forth above, wherein if a thicker plectrum is desired, then the fabricator leaves the exoskeletonas it is (its natural state), whereas if a thinner thickness is desired, then the fabricator separates the exoskeleton into a plurality of layers, here two layers. The method further includes drying the body 10 in about 400 degree F. heat+/−50 degree F. for about ten (10) minutes+/−five (5) minutes.

Where after the method involves sanding the surfaces of the body 10 to the desired smoothness while the body 10 is still hot, namely, above ambient temperature after being removed from the 400 degree F. heat, and thereafter permitting the body 10 to cool to ambient temperature. Once the body 10 attains ambient temperature, the method includes applying sealer to all surfaces of the body 10; and permitting body 10 to dry. Once the body 10 is dry, the plectrum is ready to use.

All of the above referenced patents; patent applications and publications are hereby incorporated by reference. Many variations of the present invention will suggest themselves to those of ordinary skill in the art in light of the above detailed description. All such obvious modifications are within the full-intended spirit and scope of the claims of the present application.

What is claimed is:

1. A plectrum comprising: a body made from an organic material comprising a horseshoe crab having a desired shape, weight, and thickness, said body having a plurality of surfaces wherein opposing sides, a first and a second side, form an edge about the perimeter of said sides, wherein said perimeter forms a silhouette, and has a plurality of corners.

2. A device as in claim 1, wherein said body is made from a material comprising an exoskeleton.

3. A device as in claim 1, wherein the first side and second side are not parallel.

4. A device as in claim 1, wherein said plectrum is made from a material having a thickness in the range of about 0.44 millimeters to about 1.5 millimeters.

5. A device as in claim 1, wherein said body as a surface area of less than about four (4) square inches.

6. A device as in claim 1, wherein said silhouette is substantially scalene.

7. A device as in claim 1, wherein each of said plurality of corners are asymmetrical to each other.

8. A device as in claim 1, wherein perimeter is substantially smooth.

9. A method of fabricating a plectrum comprising:

bleaching an exoskeleton;

forming a body of a plectrum to the desired shape and size by cutting;

drying the body in about 400 degree F. heat +/−50 degree F. for about ten (10) minutes;

sanding the surfaces of the body to the desired smoothness while the body is still hot;

permitting the body to cool to ambient temperature;

applying sealer to all surfaces of the body; and permitting body to dry.

10. A method of fabricating a plectrum as in claim 9, wherein the bleaching of the exoskeleton further comprises soaking in a solution comprising bleach for about three (3) hours.

11. A method of fabricating a plectrum as in claim 9, wherein the forming of a body further comprises separating the layers of the exoskeleton to a desired first and second thickness or leaving the layers together for a larger thickness.

12. A method of fabricating a plectrum as in claim 9, wherein the forming of the body by cutting comprises cutting by hand, by machine, or combination thereof.

13. A method of fabricating a plectrum comprising:

soaking an exoskeleton in a solution comprising bleach for a first period of time;

cutting a body from the exoskeleton to the desired shape and size;

drying the body in about 400 degree F. heat +/−50 degree F. for a second period of time;

sanding the surfaces of the body to the desired smoothness while the body is still above ambient temperature;

permitting the body to cool to ambient temperature;

applying sealer to all surfaces of the body; and permitting body to dry.

14. A method of fabricating a plectrum as in claim 13., wherein the first period of time is about three (3) hours.

15. A method of fabricating a plectrum as in claim 13, wherein the second period of time is about ten (10) minutes.

* * * * *